United States Patent [19]

Louis et al.

[11] 4,046,177

[45] Sept. 6, 1977

[54] MACHINE FOR STRAIGHTENING WIRES

[76] Inventors: Hans Louis, Weyerstrasse 213, D-565 Solingen-Wald; Eberhard Leverkus, Katternberger Strasse, D-565 Solingen-1, both of Germany

[21] Appl. No.: 690,947

[22] Filed: May 28, 1976

[30] Foreign Application Priority Data

May 30, 1975 Germany ..... 2523831

[51] Int. Cl.[2] ..... B21F 1/02; B21F 1/04

[52] U.S. Cl. ..... 140/147; 72/79

[58] Field of Search ..... 72/DIG. 10, 77, 79; 140/139, 140, 147

[56] References Cited

U.S. PATENT DOCUMENTS

| | | | |
|---|---|---|---|
| 1,610,195 | 12/1926 | Belles | 72/79 |
| 1,657,311 | 1/1928 | Malone | 140/147 X |
| 2,720,907 | 10/1955 | Seibel | 140/147 X |
| 3,857,266 | 12/1974 | Wilke | 72/79 |

FOREIGN PATENT DOCUMENTS

| | | | |
|---|---|---|---|
| 1,034,576 | 7/1958 | Germany | 72/79 |

*Primary Examiner*—E. M. Combs

*Attorney, Agent, or Firm*—Herbert E. Kidder

[57] ABSTRACT

A wire straightening machine comprising a motor-driven, rotatable hollow shaft with at least three serially arranged dies mounted thereon, having central apertures through which the wire is passed. The outer end dies are fixed with respect to the shaft, with their apertures located on the axis of rotation. The middle die is movable radially between a first position in which its aperture is coaxial with the axis of rotation, and a second position in which the aperture is eccentrically offset with respect to the axis of rotation. The middle die is carried by a block that slides through a transverse slot in the shaft, and the ends of the block have inclined parallel faces that engage inclined guideways on a slotted link, which slides axially along the shaft. An actuating device is connected to the slotted link so that the latter can be shifted axially to move the aperture of the middle die from one position to the other.

1 Claim, 4 Drawing Figures a
II
II
1
2
3
4
5
5
6
6a
7
8
8a
8
8a
8
8a
9
9a
10
10
10
10a
11
11
11
11
11
11
11
11
12
12a
12a
13
14
14a
14a
15
16
17
18
21
23

MACHINE FOR STRAIGHTENING WIRES

Figure 1:
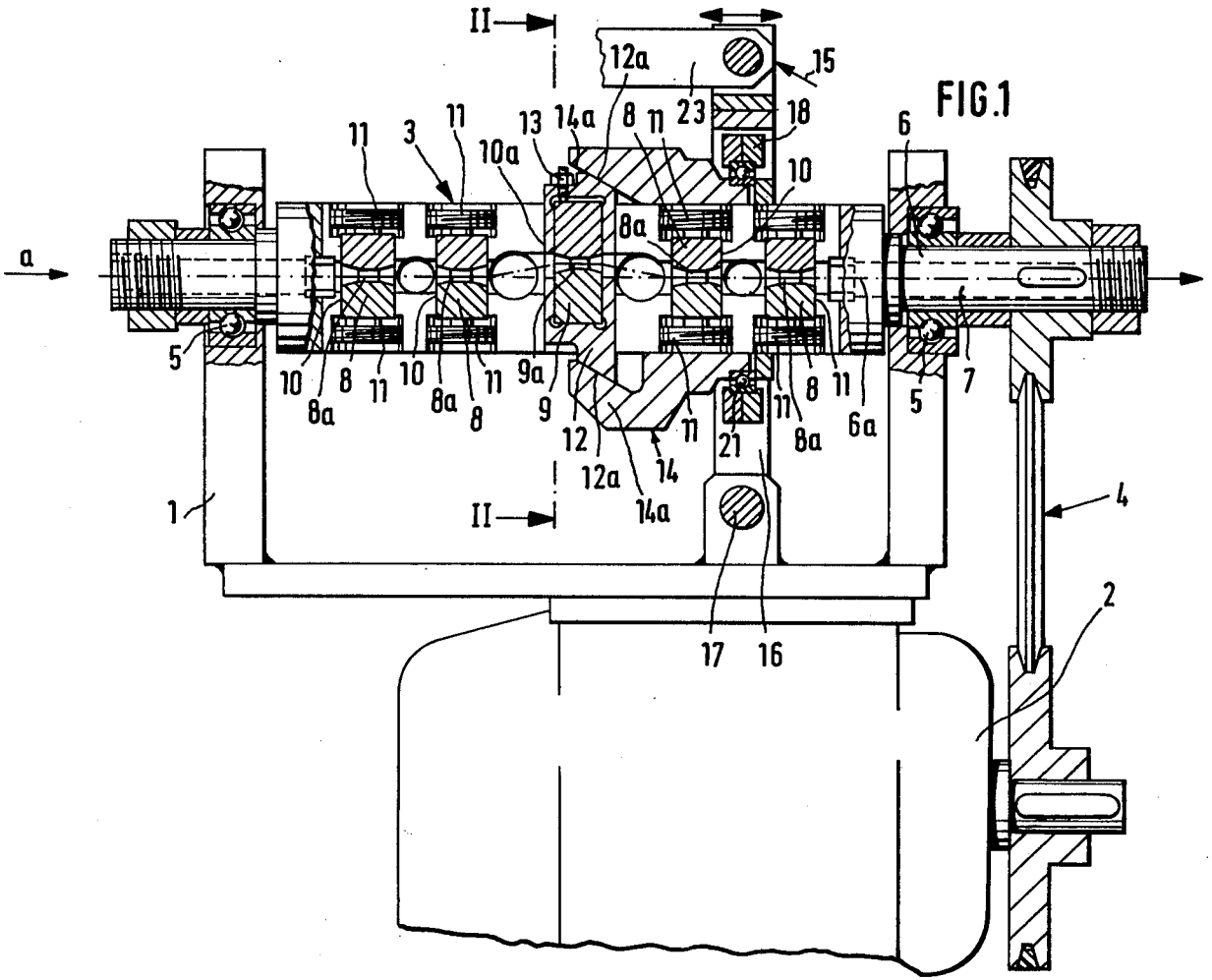

The invention relates to a machine for straightening wire having at least three serially disposed rotating dies associated with a motor drive and preferably situated on a common shaft and having guide apertures for the wire which is to be straightened, the guide apertures in the outer dies being disposed in the axis of rotation and the guide opening of the middle die being disposed eccentrically with respect to the axis of rotation. In practice, five dies are frequently employed instead of only three dies, in which case the middle die is again eccentrically disposed. Dies in the sense of the invention also refer to other straightener elements, for example straightener rolls, and straightener nozzles. In the interest of simplicity, the text hereinbelow refers exclusively to dies.

The wire which is to be straightened and is fed from a reel is continuously passed through the rotating dies. The rotational speed of the dies is approximately 3000 to 10,000 rev/min.

The eccentric die thus radially flexes the wire on all sides and therefore straightens it.

It is clear that in these circumstances the wire must maintain continuous axial motion, otherwise the wire material would suffer fatique as a result of the intensive straightening action and this could lead to fracture.

This gives rise to special problems if the processing machine on the output side does not operate continuously but intermittently or if defects occur in machine operation.

The first-mentioned problem has already been solved by arranging the straightening machine on a slide which reciprocates in the axial direction of the wire independently of the intermittent feed of the processing machine on the output side. There are no difficulties in adjusting the required speed of the straightening machine if a separate drive is employed for it. A transmission ratio of 1:2 is adopted if the drive of the straightening machine is derived from the processing machine on the output side. Accordingly, while the wire is threaded into the processing machine on the output side, the straightener machine moves in the feed direction at half the wire feed rate. The straightener machine therefore traverses over only half the distance of the feed length.

The above-mentioned steps however solve only the first of the two above-mentioned problems but not the difficulties which occur in the event of defects of the processing machine on the output side.

It is therefore an object of the invention to provide a machine of the initially mentioned kind for straightening wire, so that the problems which occur in intermittent processing as well as in the event of defects are controlled by a single mechanism without incurring special construction costs. The invention therefore provides a universally operating straightening machine which can be used under optimum conditions for intermittent as well as for continuously operating processing machines on the output side.

The invention provides that the middle die, arranged eccentrically with respect to the axis of rotation, is radially slidable in the direction of the axis of rotation so that the aperture is at least approximately in flush alignment with the axis of rotation. It is clear that with such an arrangement the straightening machine can be readily rendered inoperative, despite continued rotation of the dies, simply by displacement of the eccentric die in the event of any defect occuring on the processing machine on the output side or in the case of an intermittently operating processing machine.

It is of course possible for several of the inwardly disposed dies to be eccentrically disposed if the total number of dies exceeds three.

The radially slidable die preferably takes the form of a sliding block in an axially slidable slotted link the guideway of which is inclined at an angle to the axis of rotation. To this end, the slotted link may be constructed in bifurcated form, the two members forming the guideways.

The slotted link and the sliding block are positively interconnected against rotation so that the slotted link and the sliding block rotates in synchronism. The positive connection can be simply obtained by the guideways of the slotted link and of the sliding block being constructed as plane surfaces.

In a further embodiment of the invention, the axially slidable slotted link is supported on the axis of rotation in the manner of a sliding sleeve.

A traversing mechanism for the slotted link may take the form of a frame which extends over the slotted link, and fixedly supported in the machine frame at a distance from the axis of rotation so as to be pivotable about a pivoting shaft extending transversely to the axis of rotation, the frame acting on the one hand through securing means on the slotted link and on the other hand being connectable to an actuating device. The actuating device can be driven directly by the processing machine on the output side in such a way that in the event of defects the actuating device displaces the sliding mechanism so that the eccentrically disposed die is moved into a position which is coaxial with respect to the remaining dies. In processing machines on the output side which operate intermittently, this process can also be repeated when no wire is drawn in by the processing machine on the output side.

The fastening means may be provided with a ring which is supported in the frame and has an axis of rotation that extends radially and parallel to the pivoting shaft, the ring being slightly slidable along the frame plane and the ring being also rotatable but being axially unslidably coupled to the slotted link. Advantageously, the last-mentioned coupling can be constructed as a ball bearing.

Finally, the slidably disposed block may be mounted in a frame which in turn forms the actual sliding block of the slotted link. In view of the relatively high rate of wear of the block, this arrangement offers the advantage of dispensing with the need for refitting and manufacturing the guideways with which the block slides along the slotted link.

Figure 2:
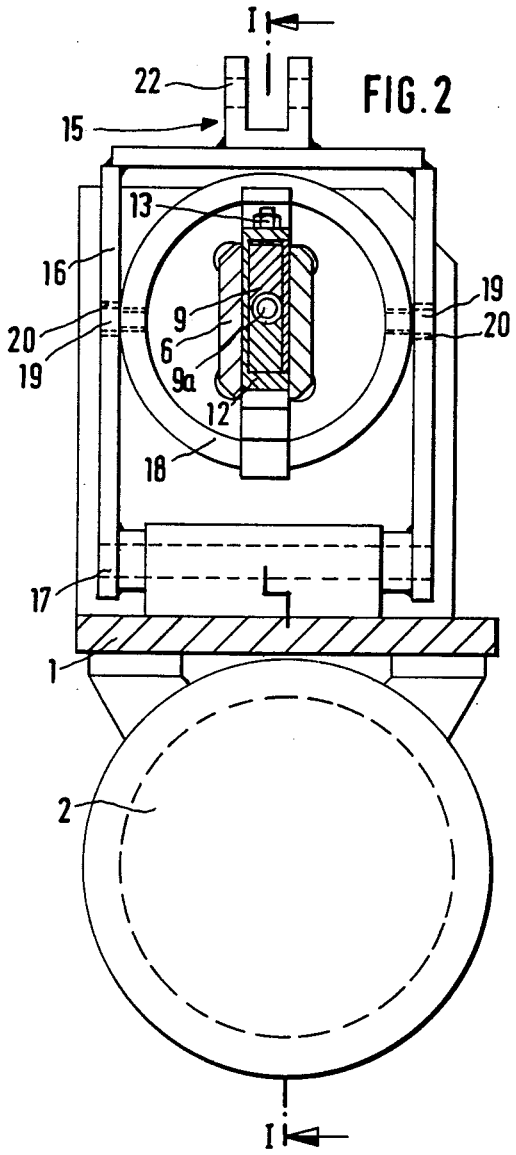
Figure 3:
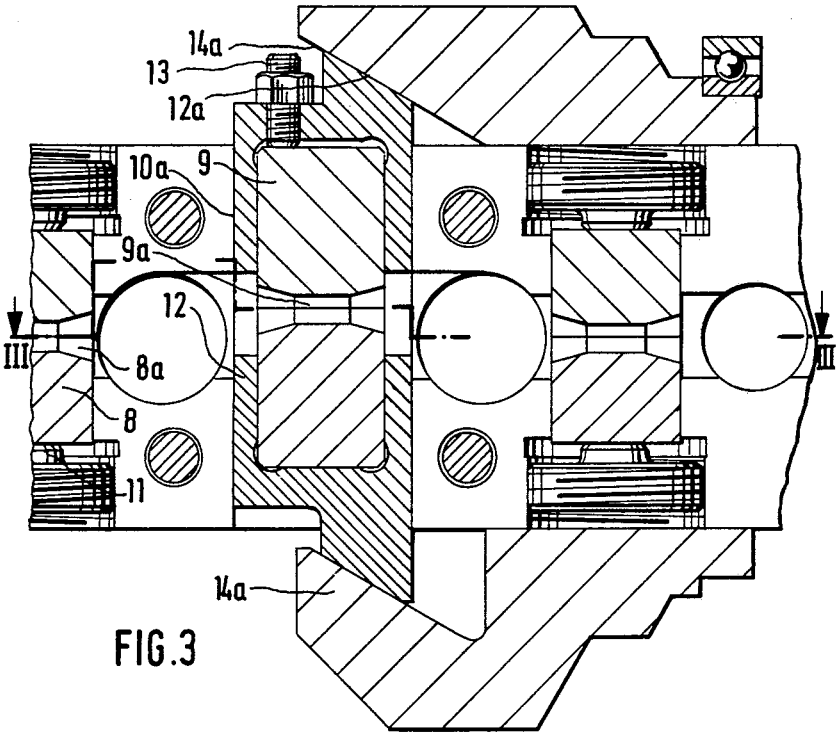
Figure 4:
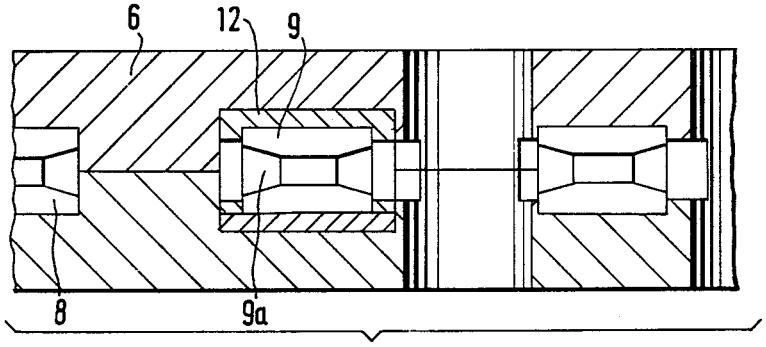

The invention will now be described by way of example with reference to the accompanying drawing, in which:

FIG. 1 is a longitudinal section through a straightening machine along the line I—I of FIG. 2, FIG. 2 is a sectional view along the line II—II of FIG. 1, FIG. 3 is an enlarged portion of FIG. 1; and FIG. 4 is a sectional view along the line III—III of FIG. 3.

The straightening machine shown in the drawings comprises a frame 1 on which a motor 2 and a straightening device 3 are mounted. The motor 2 and the straightening device 3 are coupled to each other through a belt drive 4.

The straightening device 3 has a hollow shaft 6 with a bore 7, and is supported by a ball bearing 5. The shaft 6 is set in rotation by the belt drive 4.

Five dies 8 or 9 are mounted serially in the hollow shaft 6 at a distance from each other. The two front and rear block-shaped dies 8 are inserted into corresponding guide ducts 10 which extend radially in the hollow shaft 6. Retaining screws 11 which also serve for adjustment of the dies 8 are situated on each side of the guide ducts 10 so that guide apertures 8*a* in the dies are coaxial with the axis 6*a* of the hollow shaft 6.

The die 9 and its aperture 9*a* is also arranged in a guide duct 10*a* of the hollow shaft 6, but is radially slidable. To this end, the die 9 is initially secured in a frame 12 by means of screw fasteners 13. The frame 12 has guideways 12*a* which are inclined to the axis of rotation 6*a* so that the die 9 and the frame 12 form a sliding block which is guided by its guideways 12*a* in a slotted link 14.

The slotted link 14 is axially slidably quided on the hollow shaft 6 in a manner of a sliding sleeve and is also constructed in bifurcated form, the two members 14*a* forming the guideway. This guideway, as well as the guideway 12*a* of the frame 12, is also constructed with plane faces so that both parts are positively joined to each other without being rotatable relative to each other. The slotted link 14 as well as the die 9 and the remaining dies 8 therefore rotate with the rotating shaft 6.

A traversing mechanism 15 for the slotted link 14 has a frame 16 which is fixedly supported in the machine frame 1 in a pivoting shaft 17 at a distance from the hollow shaft 6*a*. The pivoting shaft 17 extends perpendicularly to the axis of rotation 6*a*. The frame 16 is provided with a ring 18 having an axis of rotation parallel to the pivoting axis 17 and with bearing trunnions 19 by means of which it is rotatably supported in the frame 16. The bearings 20 in the frame 16 are constructed as slots so that the ring 18 is slightly slidable along the plane of the frame but not perpendicularly thereto.

The ring 18 is also rotatable by means of a ball bearing 21, but is axially unslidably coupled to the slotted link 14.

On the side opposite to the pivoting axis 17 the frame 16 has a bifurcated member 22 on which an actuating lever 23 is mounted which leads to an actuating device (not shown).

The straightening machine as illustrated operates as follows:

In FIG. 1, the straightening machine is in the operating position. The wire that is to be straightened passes through the machine in the direction of the arrow *a*, is flexed by the eccentrically rotating die 9 and is thus straightened. As soon as no wire can be drawn into a processing machine on the output side, either because of defects on the processing machine or in the case of intermittently operating processing machines, the die 9 is displaced so that its apertures 9*a* are coaxial with the apertures 8*a* of the other dies 8. The wire is therefore not processed even if the straightening machine continues to operate.

To traverse the die 9, the lever 23 is moved to the left via the actuating device, i.e. into the neutral position. Accordingly, the slotted link 14 slips to the left so that the die moves downwardly into the previously mentioned coaxial position of the apertures 9*a* and 8*a*. As soon as the processing machine resumes operation the lever 23 is moved to the right so that the die 9 again slides into the illustrated operating position.

What we claim is:

1. A machine for straightening wire, comprising:

a frame;

a hollow shaft rotatably supported on said frame;

a motor connected to said shaft to drive the same;

at least three axially spaced dies mounted on said shaft and rotatable therewith, each of said dies having a central aperture through which the wire passes, and the end dies having their apertures located on the axis of rotation of the shaft;

the middle die being slidable radially with respect to the hollow shaft between a first position wherein its aperture is coincident with the axis of rotation of the shaft, and a second position displaced radially from said axis; said middle die having opposite plane surfaces that are parallel to one another and inclined with respect to the axis of rotation of the shaft;

a slotted link surrounding said middle die and slidable axially with respect to said shaft, said slotted link having opposed faces that are parallel to said plane surfaces on said middle die and in sliding contact therewith;

a ring surrounding said slotted link and having an inner bearing connected with the link so as to rotate therewith, said ring being stationary while the shaft rotates;

an actuating fork having a pair of laterally spaced legs that straddle said ring and are swingably connected to said frame, said legs being connected to said ring whereby swinging movement of the fork about its pivot axis causes said slotted link to slide axially along said shaft, thereby shifting said middle die radially from one of said positions to the other, enabling said middle die to be shifted instantaneously from said second position to said first position when the wire is momentarily halted in its progress through the machine so as to prevent fatigue-stressing of the wire; and link means connected to said actuating fork to actuate the latter in the direction to shift said middle die to said first position when the wire halts, and to said second position when the wire resumes its travel through the machine.

* * * * *